US012084162B2

(12) United States Patent
Despineux et al.

(10) Patent No.: US 12,084,162 B2
(45) Date of Patent: Sep. 10, 2024

(54) DRIVE ARRANGEMENT FOR DRIVING A BOAT

(71) Applicant: Torqeedo GmbH, Wessling (DE)

(72) Inventors: Frank Despineux, Wessling (DE); Jacob Fischer, Munich (DE)

(73) Assignee: Torqeedo GmbH, Wessling (DE)

( * ) Notice: Subject to any disclaimer, the term of this patent is extended or adjusted under 35 U.S.C. 154(b) by 232 days.

(21) Appl. No.: 17/200,161

(22) Filed: Mar. 12, 2021

(65) Prior Publication Data

US 2021/0284307 A1 Sep. 16, 2021

(30) Foreign Application Priority Data

Mar. 13, 2020 (DE) ..... 10 2020 107 040.3

(51) Int. Cl.
*B63H 5/125* (2006.01)
*B63H 21/17* (2006.01)
*B63H 23/32* (2006.01)

(52) U.S. Cl.
CPC ..... *B63H 5/125* (2013.01); *B63H 21/17* (2013.01); *B63H 23/321* (2013.01)

(58) Field of Classification Search
CPC ..... B63H 21/17; B63H 23/321; B63H 5/125; B63H 5/14
See application file for complete search history.

(56) References Cited

U.S. PATENT DOCUMENTS 2,545,086 A 3/1951 Harris
2,682,854 A * 7/1954 Cohen ..... B63H 5/165 440/72
3,076,428 A * 2/1963 Shipley ..... B63H 5/125 440/54
3,602,181 A 8/1971 Harris
4,728,307 A 3/1988 Burgess
5,795,199 A 8/1998 Langenberg et al.
6,213,821 B1 * 4/2001 Bernloehr ..... B63H 20/106 440/59
6,413,127 B1 * 7/2002 Quaeck ..... B63H 5/07 440/58
7,146,921 B2 * 12/2006 Fontanille ..... B63H 25/42 114/151

(Continued)

FOREIGN PATENT DOCUMENTS

CN 2517663 Y 10/2002
CN 1821017 A 8/2006

(Continued)

OTHER PUBLICATIONS

"Torqeedo Katalog 2009," 2009, 24 pages.

(Continued)

*Primary Examiner* — Stephen P Avila

(74) *Attorney, Agent, or Firm* — Greenberg Traurig, LLP; David J. Dykeman; Roman Fayerberg

(57) ABSTRACT

The present invention relates to a drive arrangement (10) for driving and steering a boat (1), comprising an electric drive motor (14) having a shaft (14*a*) and receiving element (12), receivable in or on a hull (3) of the boat (1), for receiving the shaft (14*a*), wherein the shaft (14*a*) is pivotably or rotatably mounted in the receiving element (12) in a position of the receiving element (12) to be arranged outside the boat hull (3).

16 Claims, 2 Drawing Sheets

(56) References Cited

U.S. PATENT DOCUMENTS

| | | | |
|---|---|---|---|
| 7,278,895 | B2 | 10/2007 | Levander |
| 2007/0232157 | A1 | 10/2007 | Lee |
| 2014/0014810 | A1 | 1/2014 | Brown |

FOREIGN PATENT DOCUMENTS

| | | | |
|---|---|---|---|
| DE | 10 2008 042 702 | A1 | 4/2010 |
| DE | 102009032787 | A1 | 1/2011 |
| DE | 102013209682 | B4 | 12/2017 |
| EP | 1870330 | B1 | 10/2011 |
| EP | 3243738 | A1 | 11/2017 |

OTHER PUBLICATIONS

"Operating Manual Ultralight 402," Sep. 15, 2009, 64 pages.
"Torqeedo Katalog 2010," 2010, 24 pages.
"Torqeedo Katalog 2011," 2011, 24 pages.
"Torqeedo Katalog 2012," 2012, 32 pages.
"Torqeedo Katalog 2013," 2013, 21 pages.
"Torqeedo Katalog 2014," 2014, 46 pages.
"Torqeedo 2015," 2015, 64 pages.
"Torqeedo Electric Boating 2016," 2016, 74 pages.
"Operating Manual Ultralight 403," Mar. 22, 2016, 72 pages.
Guldenring, Sabine, "Service Manual Ultralight 403 and 1103," Mar. 23, 2016, 17 pages.
"Torqeedo Electric Boating 2017," 2017, 76 pages.
"Torqeedo Electric Boating 2018," 2018, 76 pages.
"Torqeedo Elektromobilität auf dem Wasser 2019," 2019, 76 pages.
"Ultralight 403 A/AC 1103 AC original operating instructions", Jan. 25, 2019, 131 pages.
Ultralight 403 A (320W) Drawing No. TQ-1405-00, Jan. 30, 2019, 1 page.
Ultralight 1103 AC (915Wh) Drawing No. TQ 1408-00_IND, Aug. 21, 2019, 2 pages.
Ultralight 1103 AC (915Wh) Drawing No. TQ 1408-000, Aug. 21, 2019, 1 page.
"Torqeedo Elektromobilität auf dem Wasser 2020," 2020, 72 pages.
"Addendum to the Ultralight 1103 AC User Manual," Jan. 13, 2020, Version 1.1, 2 pages.

* cited by examiner

DRIVE ARRANGEMENT FOR DRIVING A BOAT

RELATED APPLICATION(S)

This application claims priority to and the benefit of German Patent Application No. DE 10 2020 107 040.3, filed Mar. 13, 2020, the contents of which is incorporated by reference in its entirety.

TECHNICAL FIELD

The present disclosure relates to a drive arrangement for driving a boat, and to a boat having such a drive arrangement.

BACKGROUND

Optimizing the use of space in a boat is of central importance due to the already limited space in a boat. In this context, for example, attempts are made to reduce the size of components, thereby creating more space in the boat. Efforts are also made to arrange components outside the boat hull of the boat, thereby creating more space inside of the boat.

DE102008042702 describes, for example, a drive motor arranged in a boat hull, as well as at least one gear housing and at least one control housing attached thereto with at least one propeller on an output shaft. The gear housing and the control housing are arranged outside the boat hull. The propeller is pivotable to provide steerability of the boat.

SUMMARY

Based on the known prior art, one task of the disclosure may be considered to be the provision of a drive arrangement that allows optimum use of space when integrating a drive arrangement for a boat.

In some embodiments, a drive arrangement for steering and driving a boat is proposed which comprises an electric drive motor having a shaft and a receiving element for receiving the shaft, wherein the receiving element is receivable in or on a boat hull of the boat. According to the disclosure, the shaft is pivotally or rotatably mounted in the receiving element in a position which is arranged outside of the boat hull.

This makes it possible to implement drive solutions that save space. The drive motor can be arranged outside the boat hull. Also, the shaft holding the drive motor is arranged in the receiving element in such a way that it is mounted outside the boat hull.

By relocating the receiving element outside the boat hull, it is achieved that the installation space required in the boat hull for mounting and receiving the receiving element can be reduced.

A pivotable mounting of the shaft is understood to mean that the shaft can pivot about its axis or about an axis of rotation extending through the shaft by up to 360°. A rotatable mounting of the shaft is understood to mean that the shaft can rotate about its axis or about an axis of rotation extending through the shaft by more than 360°. The pivotability or rotatability of the shaft means that, due to a corresponding rotational or pivoting orientation of the electric drive motor and the propeller connected thereto, the direction of the thrust exerted by the drive arrangement can be varied, so that—in addition to the pure propulsion of the boat, steering is also made possible. The electric drive motor can also be brought in this way into an orientation in which it is particularly well suited for hydrogeneration—for example, pivoting through 180°.

The receiving element can preferably extend through the wall of the hull of the boat. In other words, a first portion of the receiving element is arranged inside the hull of the boat and a second portion is arranged outside the hull of the boat. However, a bearing of the shaft occurs only in the second portion of the receiving element that is external to the boat hull. The result is that the first portion of the receiving element correspondingly only has to be of a small height and thus has only a small overall height within the boat hull, so that by means of the receiving arrangement, the installation space consumed by the drive arrangement can be reduced in comparison with known solutions.

The receiving element itself can preferably be constructed in such a way that the first portion, to be received within the hull, and the second portion, to be arranged outside the hull, of the receiving element are already structurally delimited from one another, for example, by the provision of fastening means for fastening the receiving element to the hull. These fastening means can be provided, for example, in the form of a flange of the receiving element to be attached to the hull, which flange is then arranged accordingly in the longitudinal direction of the receiving element between the first and second portions.

Thus, the receiving element can also provide an opening through the boat hull for passing an electrical connection to a battery housed in the boat hull for supplying electrical power to the electric drive motor. At the same time, however, the receiving element can also provide a complete seal of the interior of the boat in the opening while providing the receptacle for the shaft of the drive motor that is open to the water side.

In some embodiments, the receiving element may be arranged on a boat hull such that it lies outside the boat hull, i.e., the receiving element is arranged outside the boat hull as a whole. In this case, the receiving element is attachable to the underside of the boat via fastening means, wherein an opening is also provided through the boat hull for the passage of an electrical connection to a battery accommodated in the boat hull for supplying electrical energy to the electrical drive motor.

As a result, no installation space is required for the receiving element and thus the installation space can be further reduced compared to known solutions.

In some embodiments, the shaft is accommodated in the receiving element over substantially its entire length, wherein the bearing of the shaft nevertheless takes place outside the boat hull in order to keep the installation space to be consumed in the boat hull small. In this way, the bearing forces can be kept low, since the bearing surface extends along the entire length of the shaft. This ensures continuous or uniform bearing of the shaft in the receiving element.

By the bearing of the shaft in the receiving element, the pivotability or rotatability of the shaft about its axis is achieved as well, whereby a pivotability or rotatability of the electric motor is then also achieved, in order to align in this way the thrust of the propeller driven by the electric motor in such a way that the boat can be steered accordingly.

In some embodiments, at least two bearings are provided, which can preferably be arranged at two positions as far apart as possible between the shaft and the receiving element in order to keep the bearing forces low, also due to the widely spaced bearing points.

However, more than two bearings may be provided to further reduce the bearing forces acting on the individual bearings. All bearings can nevertheless be preferably arranged outside the boat hull. Alternatively, the bearings can also be arranged inside the boat hull.

Similarly, a seal may extend along the shaft and provide a substantially continuous seal, which may also be provided in the form of a labyrinth seal, for example. The seal provides security against the ingress of water, even when there is pivoting of the shaft in the receiving element.

However, one or more seals can also be provided along the shaft, each of which ensures tightness and, accordingly, when multiple seals are provided, they are (multiply) redundant.

As a safety measure, one or more swelling seals can be provided, which swell on contact with water and thus ensure a secure seal.

In some embodiments, the receiving element is tubular, in particular in the form of a so-called Hennegatt tube. By extending the tubular receiving element, in particular the rudder tube (German: Hennegatt tube), outside the boat hull, it is achieved that the installation space and the overall height in the boat can be kept small and yet a low-torsion reception of the shaft can be provided, since the shaft of the drive motor arrangement is received and supported over a greater extension length in the rudder tube.

The receiving element can be arranged open at the top in the boat. For example, the receiving element can end in the cockpit floor of the boat and be arranged there either open or covered. Splash water escaping upwards from the receiving element can thus be deflected in the same way as other water entering the cockpit—for example, via an open transom of the cockpit. The upper end of the receiving element in the installed state, for example, in the form of a rudder tube, is arranged above the waterline in some embodiments. In some embodiments, a seal can also be completely omitted.

However, the receiving element can also be completely closed at the top so that water can be prevented from passing through. Accordingly, the upper end can also be arranged below the waterline without this giving rise to any safety concerns.

In some embodiments, the tube designed as a receiving element is hermetically sealed at its end at the top in the installed state, for example by a cover. In this way, water can be prevented from penetrating into the hull of the boat, while at the same time a safe and stable bearing for the shaft of the drive motor can be achieved. An electrical feedthrough in the form of a sealing connector can be provided in the cover, for example, to which a power supply in the form of a battery can then be connected to power the drive motor.

In some embodiments, the shaft is supported in the receiving element by at least one bearing, such as a roller bearing or a plain bearing or a bearing bush, or a ball bearing, and the bearing is provided in a position of the receiving element arranged outside the boat hull.

In some embodiments, the shaft is supported by more than one bearing in the receiving element and all bearings are provided in positions of the receiving element arranged outside the boat hull. In this way, a further saving of installation space within the boat hull of the boat can be achieved, wherein at the same time by an appropriate dimensioning of receiving element in combination of a predetermined distance of the bearings to each other a particularly stable and torsionally stiff embodiment can be achieved.

In some embodiments, at least one sealing element is arranged in the receiving element to provide a seal between the shaft and the receiving element. By means of the sealing element, the penetration of water into the space between the receiving element and the shaft can be reduced or prevented in order to provide a seal in this way. In this way, for example, the bearings can be protected against the ingress of water and any corrosion that may occur can thus be reduced.

To ensure a seal of a dead space between the shaft and receiving element located in the direction of the boat hull, a swelling seal can also be provided, which only swells when water enters this area and provides a corresponding seal.

The receiving element can be hermetically sealed from the boat hull. For example, the receiving element can be in the form of a cylinder closed in the direction of the boat hull, for example a tube closed at the top. This prevents water from entering the boat hull via the space formed between the receiving element and the shaft.

In some embodiments, a feedthrough of an electrical connection for the electric drive motor is hermetically sealed from the inner side of the boat hull on to the electric drive motor. For example, a connector tightly terminating with the receiving element and facing the inner side of the boat hull can be provided on the receiving element, to which the battery can then be connected. This can also be a watertight cable feed-through.

The drive arrangement can be configured and dimensioned so that it can be arranged completely below the boat's construction waterline.

In some embodiments, a servo motor acting on the shaft is provided for rotating the electric drive motor about the axis of rotation formed by the shaft. The servo motor can bear against the receiving element so that a self-contained drive arrangement can be provided that allows electrical control of the direction of thrust applied to a boat by the drive arrangement.

Alternatively, the pivoting motion can also be transmitted via a linkage lever (a so-called quadrant) to the moving part of the unit, i.e., the shaft. Both the servo motor and the linkage lever can be arranged inside or outside the boat hull. The direction and the strength of the thrust can be transmitted accordingly electrically from a control station to the drive arrangement.

In some embodiments, a fastening element is provided for fastening the receiving element to the boat hull. The fastening element can be provided, for example, in the form of a flange.

In some embodiments, a boat is proposed having a drive arrangement proposed above and having a power supply for supplying power to the electric drive motor. In some embodiments, the power supply is a battery. In some embodiments, the battery connects the electric drive motor via electrical lines. In this regard, the electrical lines may be routed through a space provided for the lines in the receiving element and the shaft.

In some embodiments, the power supply additionally supplies power to an electric servo motor. The servo motor acts on the shaft arranged in the receiving element to rotate the electric drive motor about the axis of rotation formed by the shaft.

BRIEF DESCRIPTION OF THE FIGURES

Exemplary embodiments of the disclosure are explained in more detail by the following description of the figures. Thereby shows.

DETAILED DESCRIPTION

In the following, exemplary embodiments are described on the basis of the figures. Thereby, identical, similar or similarly acting elements are provided with identical reference signs in the different figures, and a repeated description of these elements is partly omitted in order to avoid redundancies.

Figure 1:
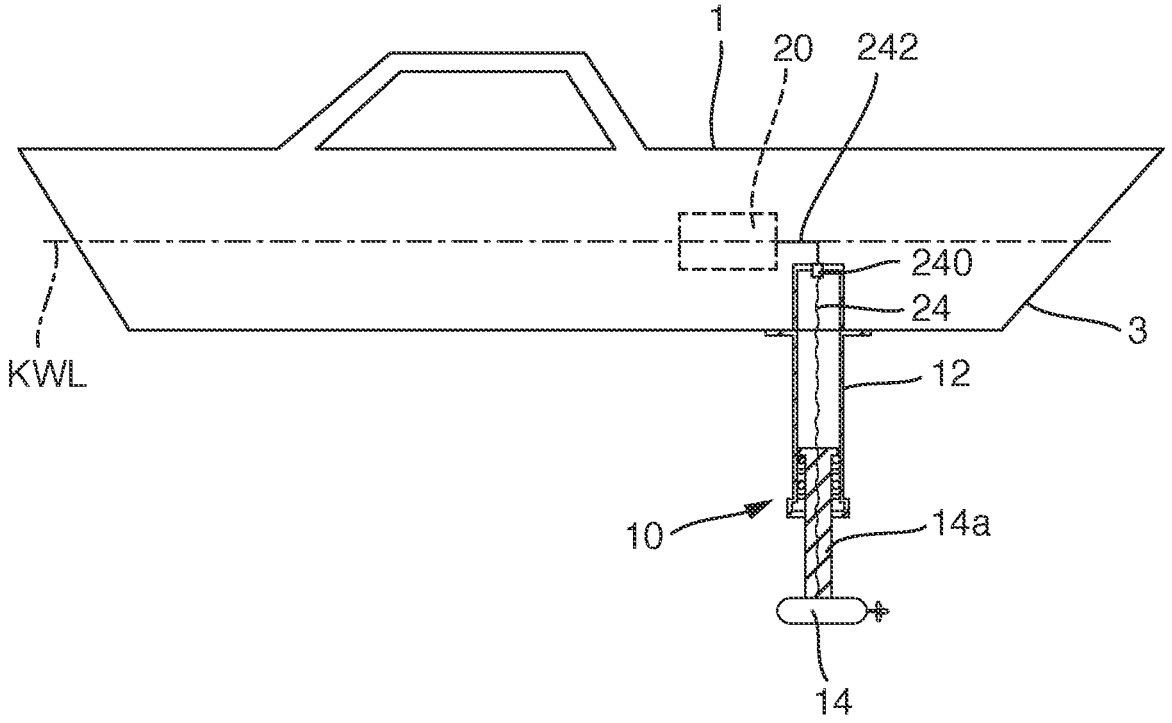
FIG. 1 a schematic view of a drive arrangement and its arrangement on a boat according to an embodiment.

FIG. 1 shows a schematic view of a drive arrangement and its arrangement on a boat 1.

The drive arrangement 10 comprises an electric drive motor 14 having a shaft 14*a*, and a receiving element 12 receivable in a boat hull 3 of the boat 1 to receive the shaft 14*a*. The shaft 14*a* is pivotally or rotatably mounted in the receiving element 12 in a position arranged outside the boat hull 3, thereby achieving control of the boat 1.

The illustrated embodiment schematically shows a battery 20 accommodated in the boat 1, which supplies power to the electric drive motor 14. An electrical line 24 is thereby led from the electric drive motor 14 to an upper end of the receiving element 12. The electrical line 24 is formed as a helical line to easily allow rotation of the electric drive motor 14 relative to the receiving element 12.

At the upper end of the receiving element 12, a connector 240 is provided which is hermetically sealed to the receiving element 12. The receiving element 12 is thus completely sealed from the outside of the boat hull 3 of the boat 1 in a watertight manner. The battery 20 can be connected to the connector 240 via a corresponding supply line 242, to correspondingly allow contacting of the electric drive motor 14.

Thereby, the receiving element 12 and the shaft 14*a* are configured in such a way that electrical lines 24 connect the battery 20 and the electric drive motor 14.

The drive arrangement 10 and, in particular, the receiving element 12 are arranged completely below the construction waterline KWL of the boat 1 so that the installation space above is available. This is may be helpful, for example, if the drive arrangement 10 is to be used in a boat 1 under a deeply arranged cockpit, for example, in a sailboat that is also open to the transom, for example.

Figure 2:
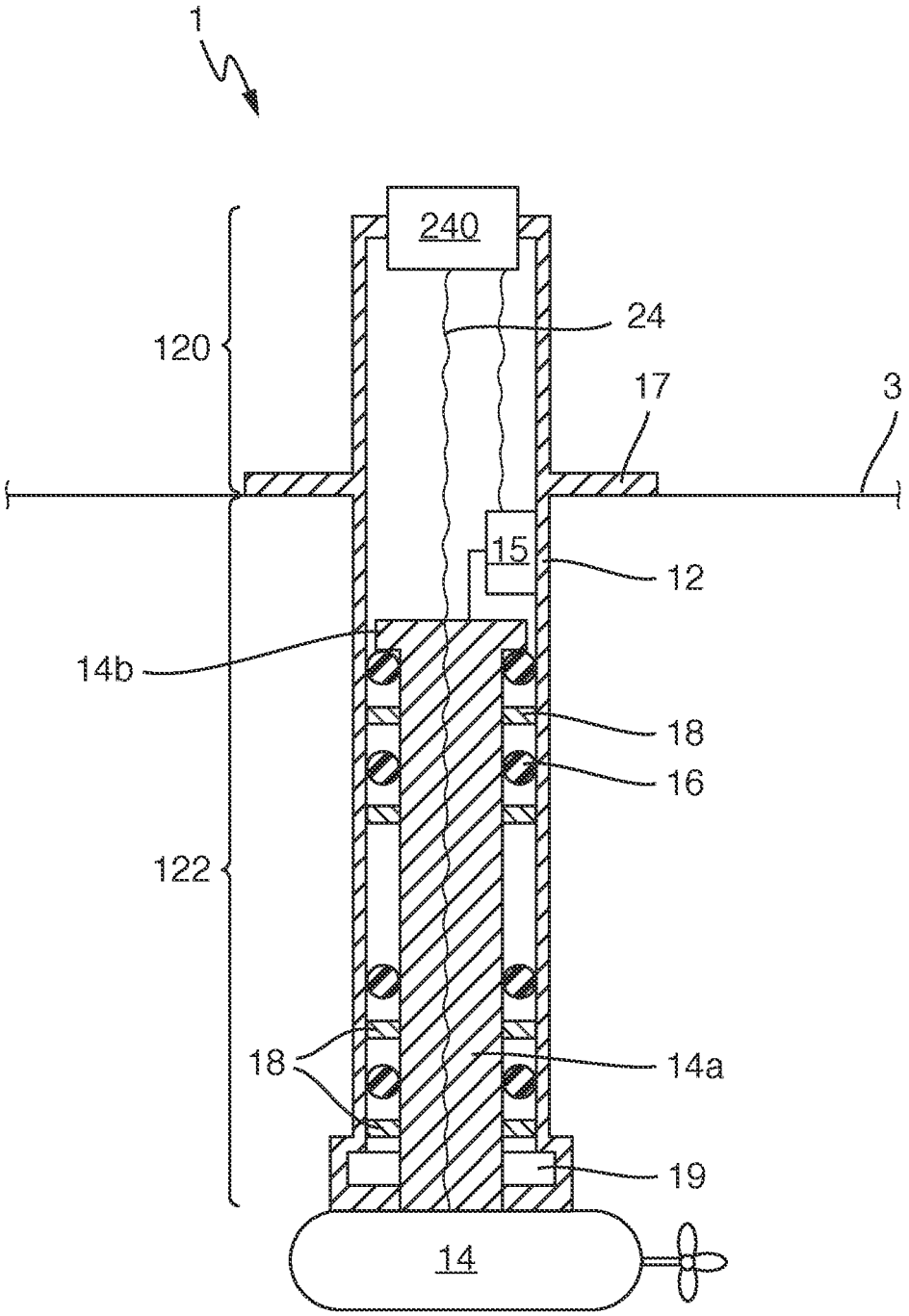
FIG. 2 a detailed section of a drive arrangement and its arrangement on a boat according to an embodiment.

FIG. 2 shows a detailed section of the drive arrangement 10.

The receiving element 12 comprises a first portion 120 arranged within the boat hull 3 of the boat 1. The receiving element 12 comprises a second portion 122 arranged outside the boat hull 3.

In the embodiment shown, the shaft 14*a* is arranged entirely in the second portion 122, which is the portion of the receiving element 12 arranged outside the boat hull 3. The bearing of the shaft 14*a* is also located entirely in the second portion 122, which is arranged outside the boat hull 3.

The arrangement of the position of the shaft 14*a* and/or the position of the bearing of the shaft 14*a* can also be determined, for example, on the drive arrangement 10 itself based on the position of a fastening element 17 provided for mounting the drive arrangement 10 on the boat hull 3.

According to the embodiment shown, the shaft 14*a* is received in the receiving element 12 along substantially the entire length of the shaft 14*a*. As a result, the installation space and overall height of the receiving element 12 in the boat 1 can be kept low, since the shaft 14*a* does not have to protrude into the interior of the boat hull 3. However, the mounting of the shaft 14*a* of the electric drive motor 14 can still be designed to be low in torsion on the boat 1, so that there is no functional loss if the dimensions are appropriate.

The shaft 14*a* is thereby pivotally or rotatably mounted in the receiving element 12 by at least two bearings 16, so that a pivoting of the shaft 14*a* also achieves a pivoting of the electric drive motor 14, which can lead to a steering of the boat 1.

A flange 14*b* is provided at the upper end of the shaft 14*a* to prevent the shaft 14*a* from slipping out of the bearings 16 and out of the receiving element 12.

All bearings 16 are thereby provided in positions arranged outside the boat hull 3 in the receiving element 12, i.e., in the second portion 122 of the receiving element 12.

The boat 1 with the drive arrangement 10 is shown here with a power supply 20 for supplying power to the electric drive motor 14. In some embodiments (not shown), the power supply 20 also supplies power to an electric servo motor 15. The servo motor 15 can act on the shaft 14*a* arranged in the receiving element 12 to rotate the electric drive motor 14 about the axis of rotation formed by the shaft 14*a*. This may facilitate steering for the user of the boat and may provide a "steer by wire" function.

Further, according to FIG. 2, within the receiving element 12 at least one sealing element 18 is arranged to provide a seal 19 between the shaft 14*a* and the receiving element 12 and to reduce or to prevent water from entering the receiving element 12.

Furthermore, it is shown by way of example that the receiving element 12 is tubular, in particular in the form of a rudder tube (German: Hennegatt tube), which can preferably be arranged completely below the construction waterline and which is sealed watertight towards the boat hull 3.

In some embodiments, the receiving element 12 is arranged substantially perpendicular to the portion of the bottom of the boat hull 3 surrounding the receiving element 12, wherein a first portion 120 of the receiving element 12 is arranged inside the boat hull 3, and wherein a second portion 122 of the receiving element 12 extends outside the boat hull 3.

The receiving element 12 can be connected to the boat hull 3 by means of a flange 17. Other ways of connecting the receiving element 12 are also conceivable, such as screwing the tubular receiving element 12 to the bottom of the boat hull 3.

LIST OF REFERENCE SIGNS

1 Boat
10 drive arrangement
12 receiving element
14 drive motor
14*a* shaft
14*b* flange
15 servo motor
16 bearing
17 flange
18 sealing element
19 seal
120 first portion
122 second portion
20 power supply
24 electrical line
240 connector
242 supply line
3 boat hull
KWL construction waterline To the extent applicable, any of the individual features shown in the embodiments may be combined and/or interchanged without departing from the scope of the present disclosure.

What is claimed is:

1. A drive arrangement for driving and steering a boat, comprising an electric drive motor having a shaft, and a receiving element for receiving the shaft, the receiving element being receivable in or on a hull of the boat, wherein the shaft is pivotably or rotatably mounted in the receiving element in a position of the receiving element arranged outside of the boat hull, wherein the receiving element is adapted and configured to be arranged substantially perpendicular to the bottom of the boat hull, wherein a first portion of the receiving element is arrangeable inside the boat hull, and wherein a second portion of the receiving element is arrangeable outside the boat hull, wherein the shaft is supported by more than one bearing in the receiving element and, in the installed state of the drive arrangement, all bearings are arranged in positions arranged outside of the boat hull, and wherein the receiving element is configured to be arranged being surrounded by a portion of a bottom of the boat hull.

2. The drive arrangement according to claim 1, wherein the shaft is received in the receiving element substantially along its entire length.

3. The drive arrangement according to claim 1, wherein the receiving element is tubular in shape and is in the shape of a rudder tube.

4. The drive arrangement according to claim 1, wherein the shaft is supported in the receiving element by at least one bearing, wherein the at least one bearing is at least one of a roller bearing, a plain bearing, a bearing bush, and a ball bearing, and the at least one bearing being provided in a position of the receiving element arranged outside of the boat hull.

5. The drive arrangement according to claim 4, wherein the shaft is supported by more than one bearing in the receiving element and all bearings are arranged in positions arranged outside of the boat hull.

6. The drive arrangement according to claim 1, wherein in the receiving element at least one sealing element is arranged to provide a seal between the shaft and the receiving element.

7. The drive arrangement according to claim 1, wherein the receiving element comprises a fastening member for receiving on the boat hull and the first portion is arranged above and the second portion is arranged below the fastening member.

8. The drive arrangement according to claim 1, wherein a servomotor acting on the shaft or a linkage lever is provided for rotating the electric drive motor about the axis of rotation formed by the shaft.

9. A boat comprising a drive arrangement for driving and steering a boat and a power source for supplying power to the electric drive motor, wherein the drive arrangement comprise an electric drive motor having a shaft, and a receiving element for receiving the shaft, the receiving element being receivable in or on a hull of the boat, wherein the shaft is pivotably or rotatably mounted in the receiving element in a position of the receiving element arranged outside of the boat hull, wherein the receiving element is arranged substantially perpendicular to the bottom of the boat hull, wherein a first portion of the receiving element is arranged inside the boat hull, and wherein a second portion of the receiving element is arranged outside the boat hull, wherein the shaft is supported by more than one bearing in the receiving element and all bearings are arranged in positions arranged outside of the boat hull, and wherein the receiving element is arranged being surrounded by a portion of a bottom of the boat hull.

10. The boat according to claim 9, wherein the shaft is received in the receiving element substantially along its entire length.

11. The boat according to claim 9, wherein the receiving element is tubular in shape and is in the shape of a rudder tube.

12. The boat according to claim 9, wherein the shaft is supported in the receiving element by at least one bearing, wherein the at least one bearing is at least one of a roller bearing, a plain bearing, a bearing bush, and a ball bearing, and the at least one bearing being provided in a position of the receiving element arranged outside of the boat hull.

13. The boat according to claim 12, wherein the shaft is supported by more than one bearing in the receiving element and all bearings are arranged in positions arranged outside of the boat hull.

14. The boat according to claim 9, wherein in the receiving element at least one sealing element is arranged to provide a seal between the shaft and the receiving element.

15. The boat according to claim 9, wherein the receiving element comprises a fastening member for receiving on the boat hull and the first portion is arranged above and the second portion is arranged below the fastening member.

16. The boat according to claim 9, wherein a servomotor acting on the shaft or a linkage lever is provided for rotating the electric drive motor about the axis of rotation formed by the shaft.

* * * * *